US005141126A

United States Patent [19]

Takata et al.

[11] Patent Number: 5,141,126

[45] Date of Patent: Aug. 25, 1992

[54] CONTAINER AND METHOD OF AND APPARATUS FOR NOTCHING THE SAME

[75] Inventors: Yukio Takata; Takeshi Shinohara, Himeji, both of Japan

[73] Assignee: Idemitsu Petrochemical Co., Ltd., Tokyo, Japan

[21] Appl. No.: 374,134

[22] Filed: Jun. 30, 1989

[30] Foreign Application Priority Data

Jul. 1, 1988 [JP] Japan ..... 63-165580
Sep. 28, 1988 [JP] Japan ..... 63-245562

[51] Int. Cl.[5] ..... B65D 41/00
[52] U.S. Cl. ..... 220/359; 220/453
[58] Field of Search ..... 220/453, 329, 270, 260, 220/257

[56] References Cited

U.S. PATENT DOCUMENTS 4,044,941 8/1977 Knudsen ..... 220/359
4,207,989 6/1980 Ingemann ..... 220/359
4,280,653 7/1981 Elias ..... 220/359
4,693,390 9/1987 Hekal ..... 220/359
4,759,463 7/1988 Mazoin ..... 220/359
4,801,041 1/1989 Takata et al. ..... 220/359
4,865,217 9/1989 Yoshimoto ..... 220/359
4,913,307 4/1990 Takata et al. ..... 220/359

*Primary Examiner*—Joseph Man-Fu Moy
*Attorney, Agent, or Firm*—Antonelli, Terry Stout & Kraus

[57] ABSTRACT

A container, a method of an an apparatus for forming cuts in the container are disclosed. Weakening lines serving as cutting lines are formed on inside of the sealing portion and outside of the flange portion of the container, and a non-sealing region is formed at the position at which a part of the outer weakening line is included. These weakening lines can be formed by rotating the container and bringing the notching blades into contact with the flange portion.

10 Claims, 16 Drawing Sheets

CONTAINER AND METHOD OF AND APPARATUS FOR NOTCHING THE SAME

BACKGROUND OF THE INVENTION

1. Field of the Invention

The present invention relates to a container exhibiting an excellent sealing performance and capable of being easily opened and sealed and a method of and apparatus for notching the same.

2. Description of the Related Art

Hitherto, containers of the following type for packing food are widely used which comprises a main container body having a flange portion and a cover, this flange portion being welded to the cover for sealing. In order to make such containers to attain both a capability of being readily opened and an excellent sealing performance, they are designed in such a manner that the adhesive force acting between layers of the container which is formed to be a multilayered structure is arranged to be smaller than the adhesive force acting between the flange portion and the cover. Furthermore, a non-sealing portion is formed inside this sealing portion and a notch which serves as a weakening line is formed in this non-sealing portion so that the layers forming the main container body are separated from each other from the outer periphery thereof to the notch when this container is intended to be opened. Furthermore, in order to improve the rigidity of such containers, there are containers of the type having a flange portion in which a bent portion such as a rib, a skirt, a curl or the like is formed. In the container of the type described above, a cutting line is formed as to serve as an weakening line on the outer periphery of the sealing portion in order to improve the capability of being readily opened so that the layers forming the main container body are separated from each other starting from the thus-formed cutting line.

However, in the case where the cutting line is previously formed in the flange portion, it is difficult to accurately perform the welding for sealing at the position of this cutting line. If the outer periphery of the sealing does not meet accurately in the inner or outer portion of the cutting line, the opening of the container becomes difficult to be performed.

To this end, a container capable of overcoming the above-described problem is proposed (Japanese Patent Laid-Open No. 63-96060), this container being arranged such that the rib in the opening portion is cut out as to meet the cut surface in the outer periphery of the flange portion and the outer periphery of the sealing portion.

However, in this conventional example, the following problems arisen:

(1) since the rib in the flange portion is cut off, the rigidity and the strength in this cut portion can deteriorate, in addition (2) edges can be adversely broken on both sides of the cut portion when the container is opened, and the peeling remainder is generated in the opened surface, causing the appearance of the container to deteriorate, and (3) since the outer periphery of the sealing is made to meet the cut surface of the outside end of the flange portion, the sealing work cannot necessarily be conducted easily and the width of the sealing portion cannot be optionally determined.

If a material having a proper sealing strength were selected for the purpose of improving the capability of being readily opened, the sealing performance can inevitably changed due to the sealing conditions such as temperature, pressure, time and the like, and impurities such as a filler. Therefore, a uniform adhesive force cannot be obtained, and the sealing performance deteriorates. As a result, such a container cannot be used for packing retort foods whose inner pressure is involved to be raised for disinfection by heating.

Therefore, the applicant of the present invention has disclosed a structure (Japanese patent Publication No. 61-229591) arranged such that the container is designed to be a multilayered structure comprising a cover, an inner layer (a first layer) to be sealed to the cover, and an outer layer (a second layer) to overlap the inner layer, and the inner layer can be separated from the outer layer. Furthermore, a notch is formed in the inner layer of a non-sealing portion in the flange portion so that the container is opened by separating the inner layer from the outer layer starting from this notch.

The container of the type described above needs to be provided with the notch in the inner layer of the flange portion thereof The following method and apparatus can be employed for forming a notch of the type described above:

Art I (Japanese Patent Publication No. 61-229591) in which the notch is formed, in the manufacturing process for the container, by pressing an annular notching blade to the flange of the container with this flange received by a receiving member such as a mold; and Art II (Japanese Patent Publication no. 61-229592) in which the notch is formed by means of pressing by using the notching blade and/or heating means.

However, in the above-described Arts I and II, since the flange of the container needs to be received by a mold or the like for forming the notch, the notch can be formed only in the flat portion of the flange. It is difficult to apply these arts to a flange having a bent portion such as a rib or a curling. In addition, the formed notches become non-uniform if the thickness of the flange is not uniform. Furthermore, in the Art I the cost for manufacturing the annular notching blade is expensive, the notch cannot be formed in the flange portion cheaply.

SUMMARY OF THE INVENTION

An object of the present invention is to provide a container which can be readily opened and the working efficiency can be improved In order to achieve this object, the container according to the present invention comprises an inner layer which confronts the inside portion of the main container body and an outer layer which overlaps the inner layer such that it can separate from the inner layer which are included in at least one of the main container body and the cover when the main container body and the cover are molded, wherein the adhesion force between the inner layer and the outer layer is arranged to be smaller than that between the flange portion of the main container body and the cover, an inner weakening line is formed inner than the sealing portion in the flange portion including the inner layer and the outer layer or in the flange portion at which the cover including the inner layer and the outer layer overlaps while an outer weakening line is formed outer than the sealing portion, and a non-sealing region is formed in the cover and/or the flange portion at the position which includes a portion which corresponds to a portion of the outer weakening line.

According to the thus-structured invention, the main container body and the cover are welded to each other for sealing by a proper sealing means such as heat sealing. Prior to performing this welding for the purpose of sealing, a non-sealing portion is formed in the cover, and the flange portion and the cover are welded to each other for sealing such that and the outer periphery of the portion to be welded for sealing overlaps the non-sealing portion. It needs for the outer periphery of the sealing to overlap the non-sealing portion, and the outer periphery of the sealing portion does not necessarily need to meet the outer weakening line.

Since the container is thus-formed, the layers of the flange portion start separation at the end portion or the like of the non-sealing portion which meets the outer periphery of the sealing when the cover is pulled from the end thereof toward to the central portion of the container.

The main container body according to the present invention comprises:

an inner layer which confronts the inside portion of the main container body and an outer layer which overlaps the inner layer such that it can separate from the inner layer which are included in the main container body formed, wherein the adhesion force between the inner layer and the outer layer is arranged to be smaller than that between the flange portion and a cover, an inner weakening line is formed on inside of said flange portion while a cutting line is formed outer than the inner weakening line, and a non-sealing region for preventing the cover from being welded for sealing to the inner layer is formed in the flange portion at the portion which includes a portion which corresponds to a part of the cutting line.

According to this embodiment, when the main container body and the cover are welded to each other for sealing, the outer periphery of the portion to be sealed is arranged to overlap the non-sealing portion. Also in this case, the outer periphery of the sealing needs to overlap the non-sealing portion, and the outer periphery of the sealing portion does not necessarily meet the cutting line.

A further object of the present invention is to provide a container having a rib or a curled portion in the flange at the end of the flange portion thereof and capable of making the layers forming the main body of the multi-layered container readily open by arranging the structure of the corners of the outer periphery of the flange portion.

In order to achieve the above-described object, the present invention comprises a rib or curled portion; and an annular notch formed in the adjacent to the inner periphery of a flange portion of a flange-provided multi-layered container in which the inner layer thereof and a layer which is positioned in contact with this inner layer can be separated from each other; wherein a boundary surface between an innermost layer and a layer which is positioned in contact with the innermost layer is allowed to appear at the corners of the outer periphery of the flange portion.

A still further object of the present invention is to provide a method of and an apparatus for notching a container capable of forming a flange whose shape is not limited at any desired position.

The method according to the present invention for notching a container with which the container having a flange at the opening thereof is cut by a notching blade, the method comprising: relatively moving the container and the notching blade in the circumferential direction of the opening of the container, the container being arranged such that it include an inner layer which confronts the inside portion of the container and an outer layer which overlaps the inner layer and the inner layer can be separated from the outer layer, whereby notches are formed in the inner layer of the container.

The apparatus for notching the container according to the present invention comprises: holding means for holding the container, a notching blade for forming the notch in the container, and a rotational means, the holding means for holding a container which has a circular opening, in which a flange is formed, which includes an inner layer which confronts the inside portion of the container and an outer layer which overlaps the inner layer and the inner layer is capable of being separated from the outer layer;

the notching blade for forming a notch in the inner layer of the container; and the rotational means for rotating at least one of the holding means and the notching blade relative to the center of the opening of the container for the purpose of making the container and the notching blade move relatively in the circumferential direction of the opening of the container.

According to the thus-structured invention, when at least either of the container held by the holding means or the notching blade is rotated relative to the opening of the container by the rotating means, the container and the notching blade can be relatively moved in the circumferential direction of the opening so that the notch is formed in the container.

According to the present invention, since no receiving member such as a mold for receiving the flange does not need to be provided, the notch can be formed in the flange of the flat type or a flange having a rib, curling or the like. In addition, by adjusting the relative position between the notching blade and the container, the notch can be formed at any desired position in the flange. Furthermore, a relatively cheap notching blade can be used as an alternative to an expensive annular notching blade. Therefore, the cost required for forming the notch can be significantly reduced.

BRIEF DESCRIPTION OF THE DRAWINGS

FIGS. 6(A) and 6(B) to 10 are views which illustrate modifications of the above-described embodiments;

Figure 16:
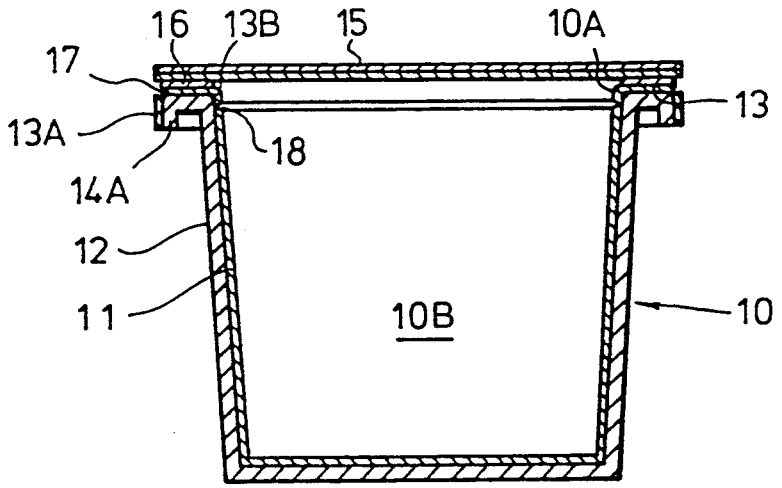
Figure 17:
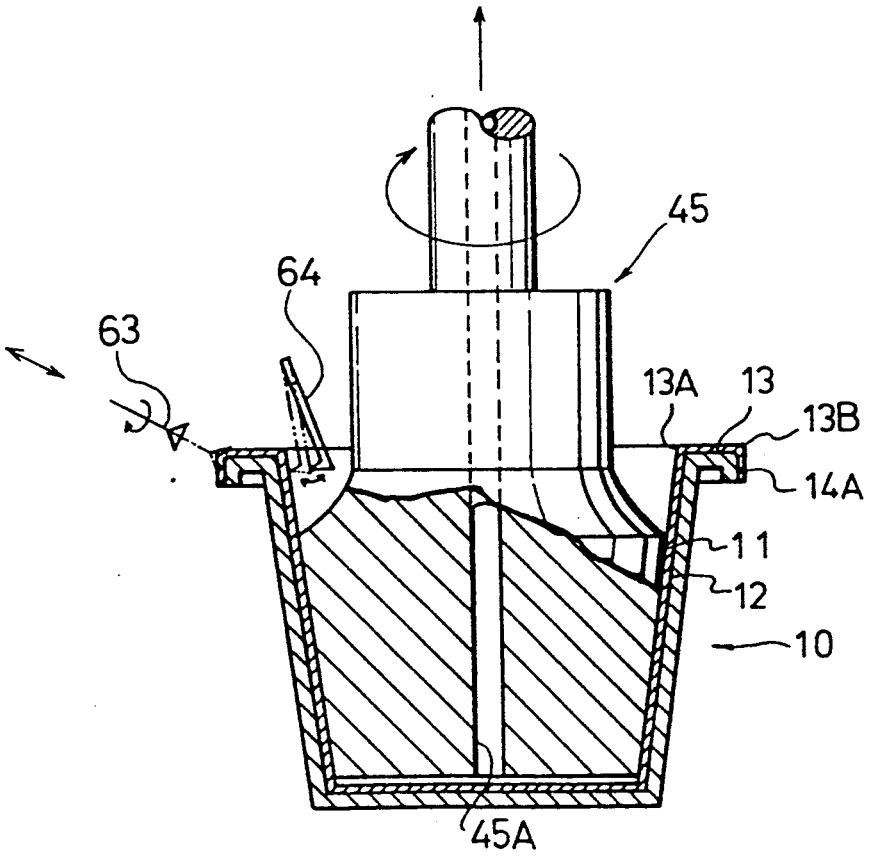
Figure 19:
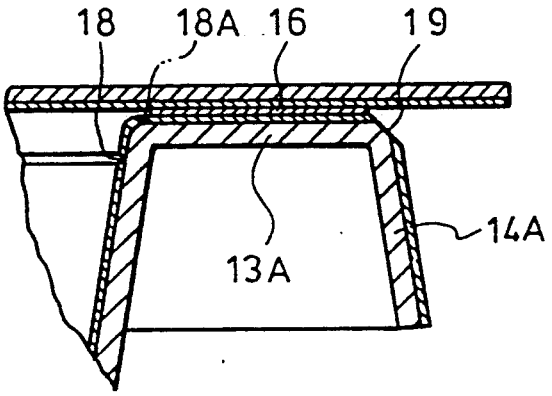
Figure 20:
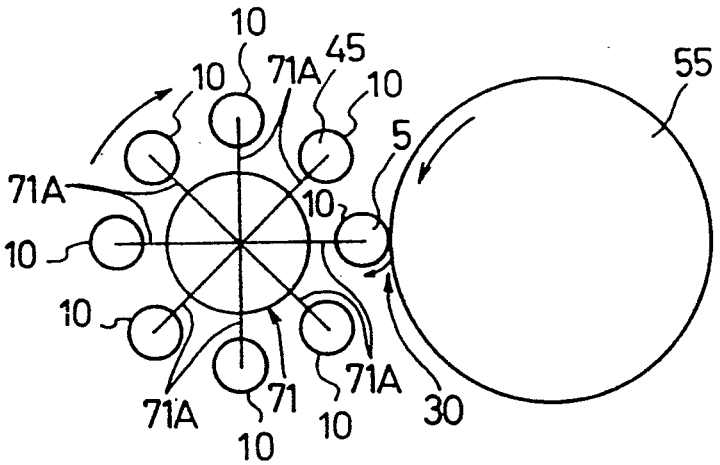
Figure 21:
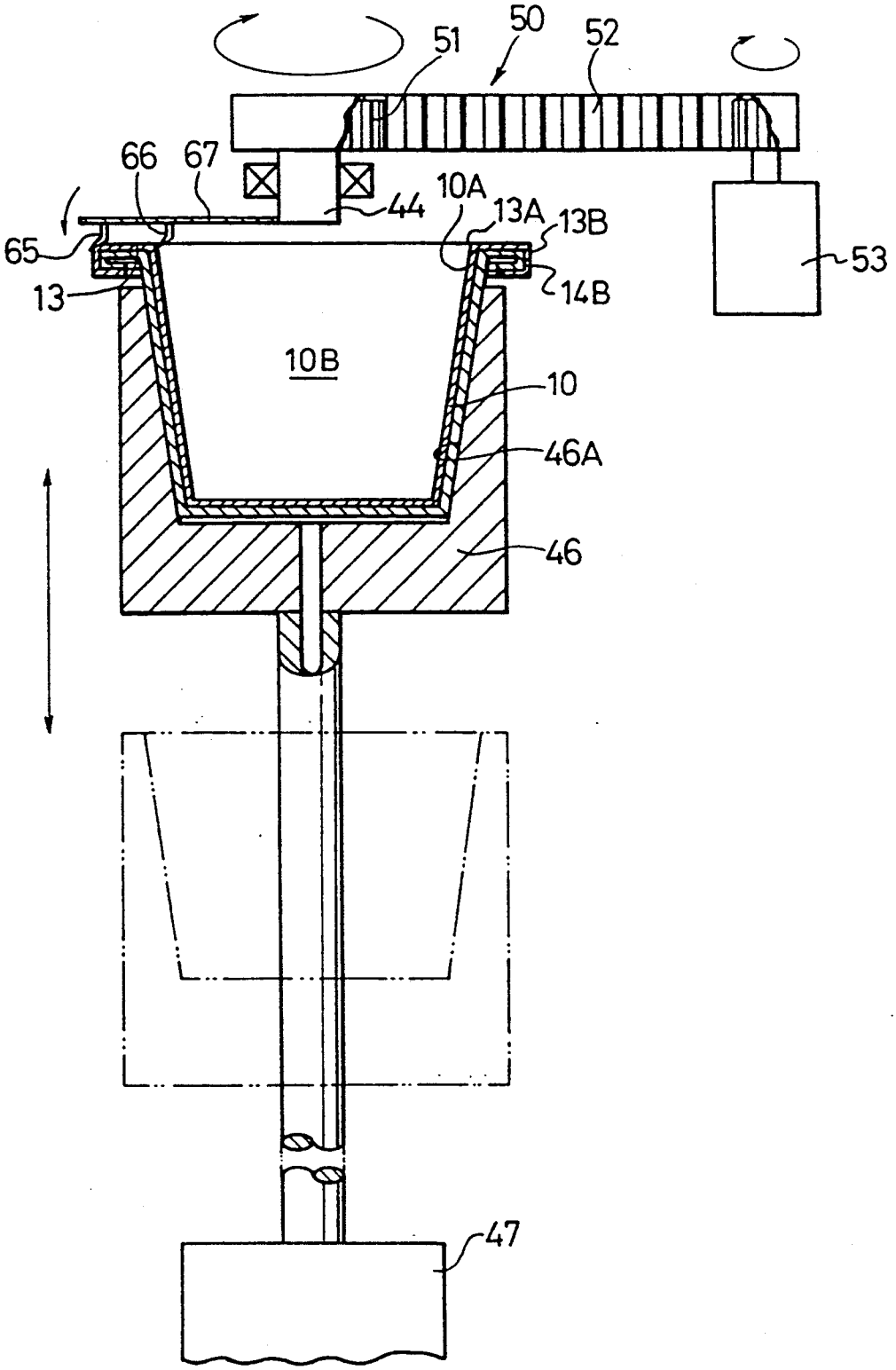
Figure 22:
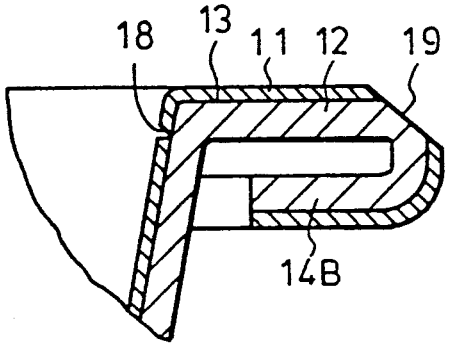
Figure 23:
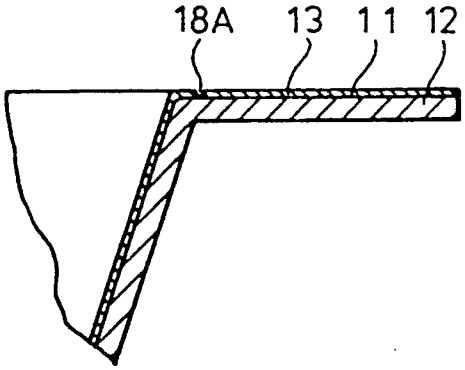

FIGS. (15A) to (15D) are views which illustrate the method according to the first embodiment;

FIG. 16 is a cross-sectional view which illustrates a container to be notch;

FIG. 17 is a schematic structural view which illustrates other embodiment;

FIGS. (18A) to (18D) are views which illustrate the method according to the above-described other embodiment;

FIG. 19 is a cross-sectional view which illustrates a container to be notch;

FIGS. 20 and 21 are schematic structural views which illustrate the apparatus according the other embodiments;

FIG. 22 is a cross-sectional view which illustrates an essential portion of a notch according to the above-described embodiment; and FIG. 23 is a cross-sectional view which illustrate an essential portion of the other embodiment to be cut according to the present invention.

DETAILED DESCRIPTION OF THE PREFERRED EMBODIMENT

Embodiments of the present invention will be described with reference to the drawings. In the following embodiments, the same or similar components are given the same reference numerals and the description about them are simplified or omitted.

Figure 1:
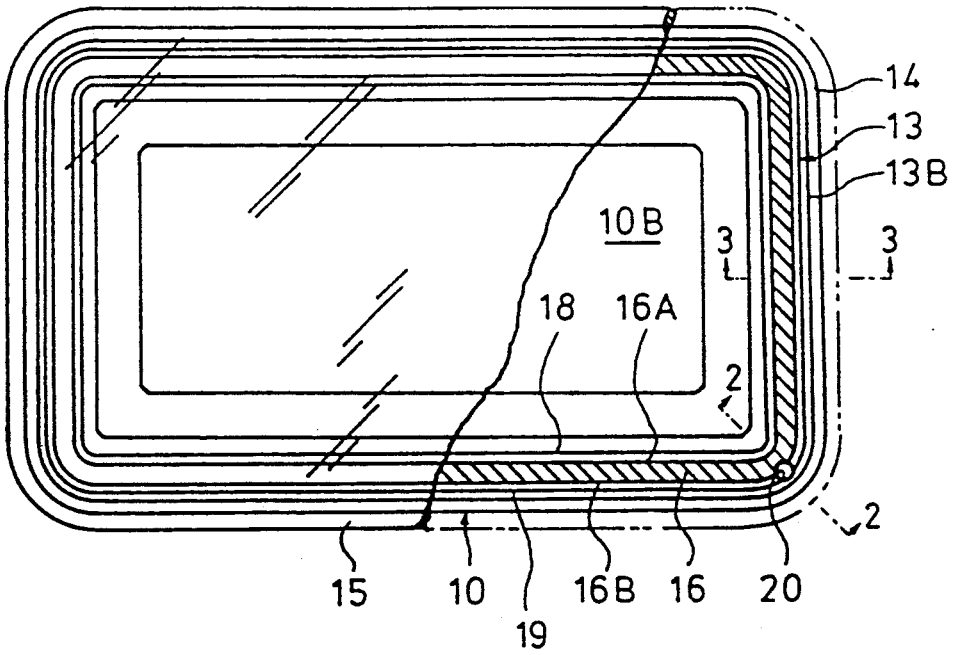
FIG. 1 is a plan view which illustrates a first embodiment of a container according to the present invention.
Figure 2:
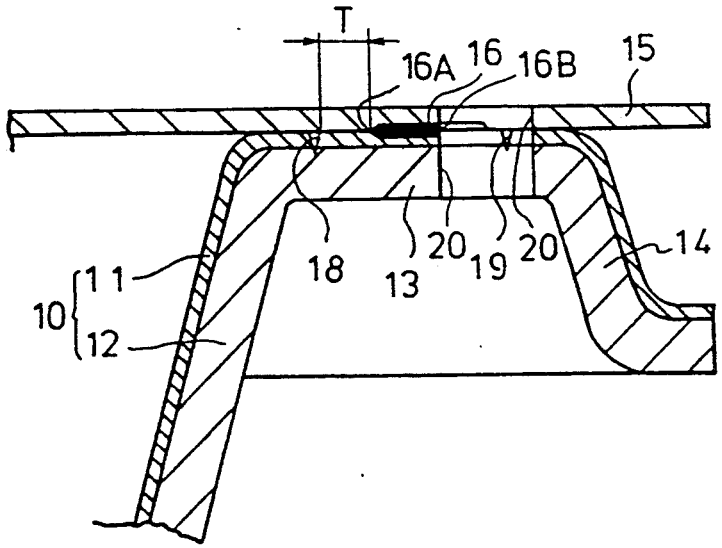
FIG. 2 is a cross-sectional view taken along line II—II of FIG. 1.
Figure 3:
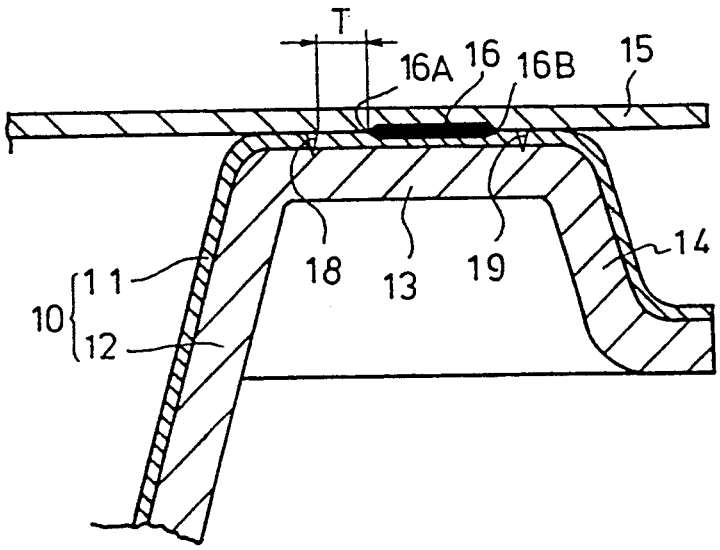
FIG. 3 is a cross-sectional view taken along line III—III of FIG. 1.

FIGS. 1 to 3 are views which illustrate a first embodiment of the present invention. Referring to these drawings, a main container body 10 is formed in a substantially rectangular plate-like shape having a flange portion 13 at the top thereof. An outer peripheral 13B of this flange portion 13 is provided with a skirt portion 14 facing the bottom portion of the main container body 10, this skirt portion 14 serving as a portion to be bent. A cover 15 is welded to the above-described flange portion 13 so that an elongated sealing portion 16 is formed between the cover 15 and the flange portion 13.

The main container body 10 is formed to be a multilayered structure which includes at least two layers consisting of an inner layer (a first layer) 11 confronting an inside portion 10B of the main container body 10 and an outer layer 12 (a second layer) which is so polymerized with this inner layer 11 as to be able to be separated from it. The peel strength between the inner layer 11 and the outer layer 12 is 300 to 2000g/15mm (tension speed 300mm/min to be identical hereinafter), preferably 400 to 1500g/15mm, this strength being required to be at least smaller than the sealing strength between the flange portion 13 and the cover 15.

In the inner layer 11 of the flange portion 13, a notch 18 serving as an inner weakening line is formed at the position inner than a seal inner periphery 16A at a predetermined distance preferably T, while a cutting line 19 serving as an outer weakening line is formed outer than the seal outer periphery 16B. It is preferable that the depth of the notch 18 and the cutting line 19 reaches the boundary between the inner layer 11 and the outer layer 12. It is necessary for the structure to be arranged such that when the cover 15 is intended to be opened, the inner layer 11 and the outer layer 12 can be separated from each other from the cutting line 19 to the notch 18, causing the container to be opened.

In the portion where the corner of the flange portion 13 and that of the cover 15 corresponds to each other, a hole portion 20 which serves as a non-sealing portion is formed, this hole portion 20 including a portion which corresponds to a portion of the cutting line 19, and the outer peripheral of this hole portion 20 with respect to the central portion of the container is arranged to be the seal outer peripheral 16B. This hole portion 20 is, as shown in FIG. 1, arranged such that the shape is formed to be circular and the number of it is one according to this embodiment. However, the position at which this hole portion is formed is not particularly limited and a plurality of holes may be formed there.

The material for the main container body 10 is not limited particularly, it being exemplified by: polyolefin resin, polystylene resin, polyamide resin, polyester resin, polycarbonate resin, a mixtures consisting of the above-described substances, a resin prepared by adding thermoplastic elastomer, various additives, or inorganic fillers in an amount of 5 to 70 wt %, and metal foil. In order to satisfy the required peel strength, a suitable material needs to be selected from a combination of the layers each of which is formed by the above-described materials.

An example of the combinations of the materials forming a material (a) of the inner layer 11 and that (b) of the outer layer 12 will be described as follows, where the present invention is not limited to the following description.

(a) polyethylene resin such as high density polyethylene or low density polyethylene and (b) mixed resin consisting of polypropylene resin and polyethylene resin;
(a) polypropylene resin and (b) mixed resin consisting of polypropylene resin and polyethylene resin;
(a) low density polyethylene and (b) high density polyethylene resin;
(a) ethylene-vinyl acetate copolymer and (b) mixed resin consisting of polypropylene resin and polyethylene resin;
(a) ethylene-vinyl acetate copolymer and (b) mixed resin consisting of ethylene-propylene random copolymer resin;
(a) mixed resin consisting of polypropylene resin or polypropylene resin and polyethylene resin and (b) mixed resin consisting of polypropylene resin containing inorganic filler and polyethylene resin;
(a) mixed resin consisting of polypropylene resin and polyethylene resin and (b) high density polyethylene containing inorganic filler;
(a) homo- or random polymerized polypropylene resin and
(b) high density polypropylene including inorganic filler; and
(a) unsaturated carboxylic acid modified polypropylene resin and (b) aluminum.

The main container body 10 is formed to be a double-layered structure made of the above-described materials. However, it may be formed to be a multilayered structure consisting of triple or more layers manufactured by laminating layers made of the other material for the purpose of improving a gas-barrier performance or preventing any deformation occurred in the state of the completed container. The layer made of "the other material" is exemplified by a layer made of the material exhibiting an excellent gas barrier performance such as: a resin layer made of ethylene-vinyl alcohol copolymer, polyvinylidene chloride, nylon (polyamide), and polyethylene terephthalate; and a metal layer such as an aluminum evaporated layer or a layer made of aluminum or iron. The above-described layer made of the other material may be a single layer or a multilayered structure consisting of two or more layers. It may as well be a resin layer containing an inorganic filler in an amount of 10 to 80 wt %.

A suitable structure of the layers forming the main container body 10 is selected on the basis of the resin forming the sealant layer of the cover 15. For example, in the case where the cover 15 is formed by a polyethylene sealant layers, it is preferable that a structure is selected from the above-described group of combinations of the resin layers, this structure being arranged in such a manner that the high density polyethylene layer is employed to form the inner layer 11 of the main container body 10.

The main container body 10 may be, if necessary, provided with the other layer such as a sealing layer, a heat resisting layer, or an oil-proof layer at the position inner than the innermost layer (inner layer 11) of the multilayered container if the characteristics of the present invention is satisfied such that a peeling layer is provided inside of the multilayered container. The thus-structured main container body 10 can be obtained by means of vacuum molding, compression molding, drawing, multilayer injection molding, multilayer injection blow molding, or multilayer blow molding, by using the above-described combination of resin, the laminate resin of the thus-obtained co-excluded multilayered sheet or resin sheet or film and the metal laminate. Alternatively, it can be obtained by heat forming a multilayered film on the inside of the main container body 10 made of paper or the like.

The laminate working method is exemplified by extrusion laminating, hot melt laminating, dry laminating, and an wet laminating. A multilayered material having a suitable peel strength can be obtained by the above-described laminating in a pressure sensitive agent or an adhesive agent is used.

Although the above-described cover 15 is structured to be a single-layered film, it is not limited as described above. It is not limited to this description. For example, it may be structured to be a multilayered film consisting of two or more layers. In the case where a multilayered film is employed, a structure is preferably which comprises:

a base formed by a plastic single layered film, multilayered film, paper, aluminum foil, or a material manufactured by combining the above-described materials; and a sealant layer made of resin which can be readily heat sealed to the innermost layer (inner layer 11) of the main container body 10 such as polyethylene, polypropylene, ethylene-α-olefin copolymer, ethylenevinyl acetate copolymer, and the like.

The container of the type described above is manufactured as follows: first the multilayered sheet is heated, and the above-described main container body 10 is formed from the thus-heated multilayered sheet by vacuum molding or compression molding. Then, the above-described notch 18 and the cutting line 19 are formed in prior to or after enclosing the content in the main container body 10. The notch 18 and the cutting line 19 can be formed by a physical method using a notching blade or cutting edge, a heating method such as heating ray melting (impulse) or melting in which a hot blade is used, a mechanically oscillating method by using ultrasonic wave, or an inner heating method by using high frequency. As described above, the depth of the formed notch 18 and the cutting line 19 needs to reach the inner layer 11 if it cannot reach the outer layer 12. It is reached the outer layer 12, the inner layer 11 can be assuredly separated from the outer layer 12.

Then, the flange portion 13 of the main container body 10 and the cover 15 are welded for sealing. As the means for welding for sealing, a proper means such as heat sealing or ultrasonic sealing or the like can be employed. After the flange portion 13 and the cover 15 have been welded for sealing, the flange portion 13 and the cover 15 are together punched such that the outer peripheral of the sealing portion 16 overlaps, and then the hole portion 20 is formed. At this time, this outer peripheral 16B of the sealing portion needs to overlap the hole portion 20. It is not of critical that the outer peripheral of the sealing portion 16 meets the cutting line 19.

According to the thus-structured embodiment, since the hole portion 20 is formed in both the flange portion 13 and the cover 15 while correspond to the cutting line 19 and the cover 15 does not welded, for sealing, to the flange portion 13 in this hole portion 20, the inner end of this hole portion 20 and the seal outer end 16B meet each other if the seal outer periphery 16B overlaps the hole portion 20. Therefore, when the container is intended to be opened, it can be readily opened by pulling the cover 15 at the end portion thereof toward the central portion of the container since the peeling of the layers of the flange portion 13 starts at the hole portion 20 which meets the seal outer periphery 16B. In addition, an accurate positioning in the sealing work becomes needless since the positional error in sealing with respect to the cutting line 19 is allowed if the seal outer periphery 16B overlaps the hole portion 20. As a result, the working efficiency can be improved, and the width of the sealing can be optionally selected. In addition, since the skirt portion 14 is formed in the flange portion 13 and the thus-formed skirt portion 14 is not notch, the rigidity of the container can be secured.

Figure 4:
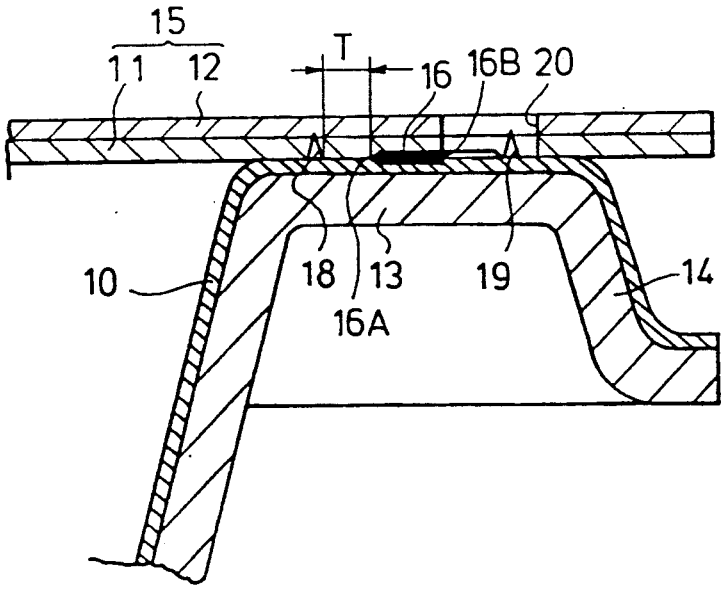
FIG. 4 is a cross-sectional view which illustrates an essential portion of a second embodiment of the present invention.

A container according to a second embodiment of the present invention is structured as shown in FIG. 4, such that: the case 15 is formed to comprise the above-described inner layer 11 and the outer layer 12; the above-described notch 18 is formed inner than the sealing portion 16 of the cover 15 and the above-described cutting line 19 is formed outer than the sealing portion 16; and the hole portion 20 in which serves as the non-sealing portion is formed at the position which corresponds to a portion of this cutting line 19. Furthermore, according to the second embodiment, the main container body 10 is not provided with the notch, cutting line and the hole portion. In addition, the material for the main container body 10 is arranged to be the same resin as that for the inner layer 12 of the case 15 as to be tight-sealed to the latter. This main container body 10 may be formed, as shown in FIG. 4, to be a multilayered structure or a single layered structure. The other factors according to the second embodiment except for the structure above are the same as those according to the first embodiment.

The container according to the second embodiment is manufactured as follows: the above-described notch 18, the cutting line 19, and the hole portion 20 are formed in the case 15; and this cover 15 is welded to the flange portion 13 of the main container body 10 in which the contents are enclosed for sealing. Also in this case, it needs for the seal outer periphery 16B to overlap the hole portion 20, but does not need to be positioned along the cutting line 19.

According also to this second embodiment, a similar effect to that obtained in the first embodiment can be obtained.

Figure 5:
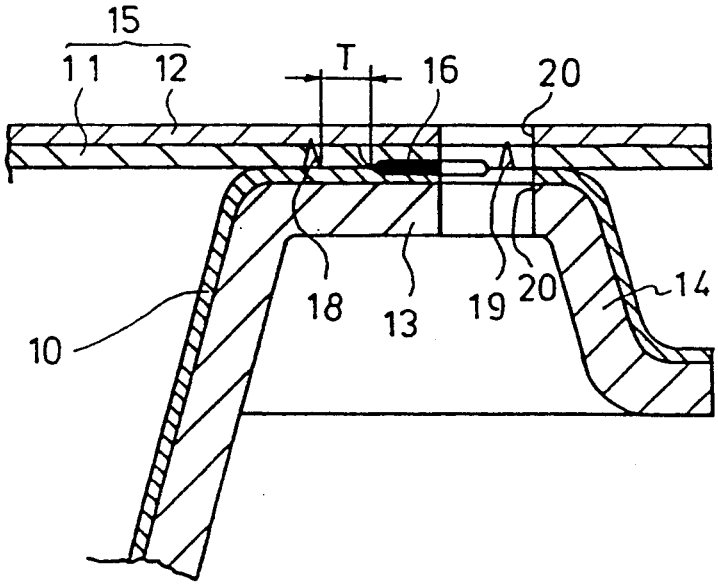
FIG. 5 is a cross-sectional view which illustrates an essential portion of a third embodiment of the present invention.

A third embodiment of the present invention is structured as shown in FIG. 5 such that the hole portion serving as the non-sealing portion is also formed in the cover 15 at the position thereof which includes a portion which corresponds to a portion of the above-described cutting line 19. The other structure is the same as that of the second embodiment.

The container according to the third embodiment is structured as follows: the above-described notch 18 and the cutting line 19 are formed in the cover 15; this cover 15 is welded, for sealing, to the flange portion 13 of the main container body 10 in which the contents are enclosed; and the flange portion 13 and the cover 15 are together punched such that the outer periphery of the seal 16 overlaps before forming the hole portion 20. Also in this case, it needs for the seal outer periphery 16B to overlap the hole portion 20, but does not need to be positioned along the cutting line 19. According also to this third embodiment, a similar effect to that obtained in the first and second embodiments can be obtained.

Figure 6A:
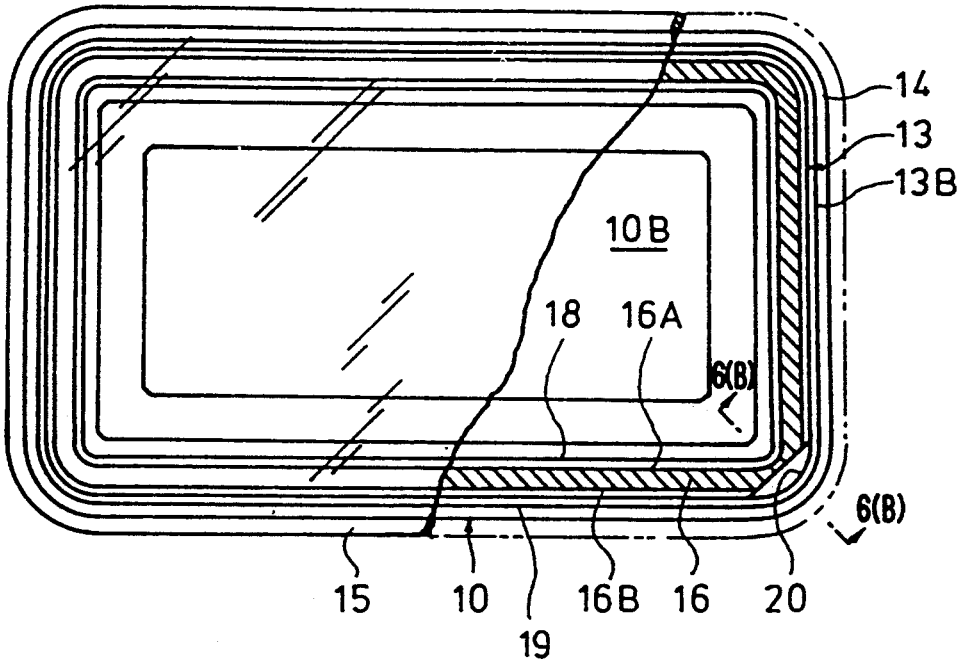
Figure 6B:
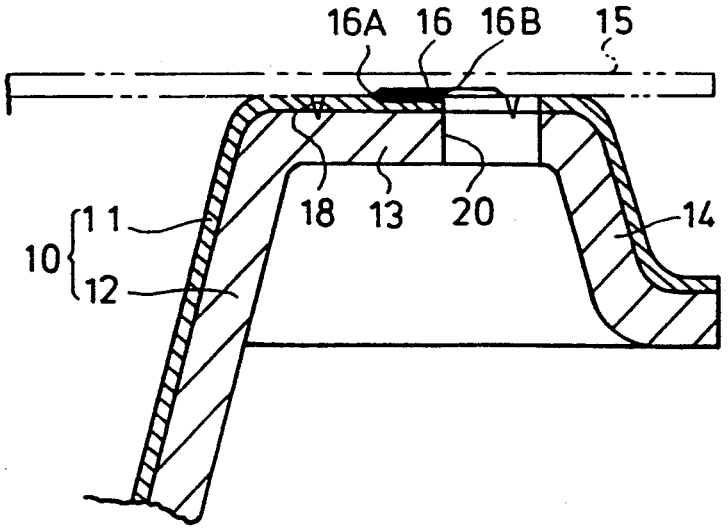
Figure 7:
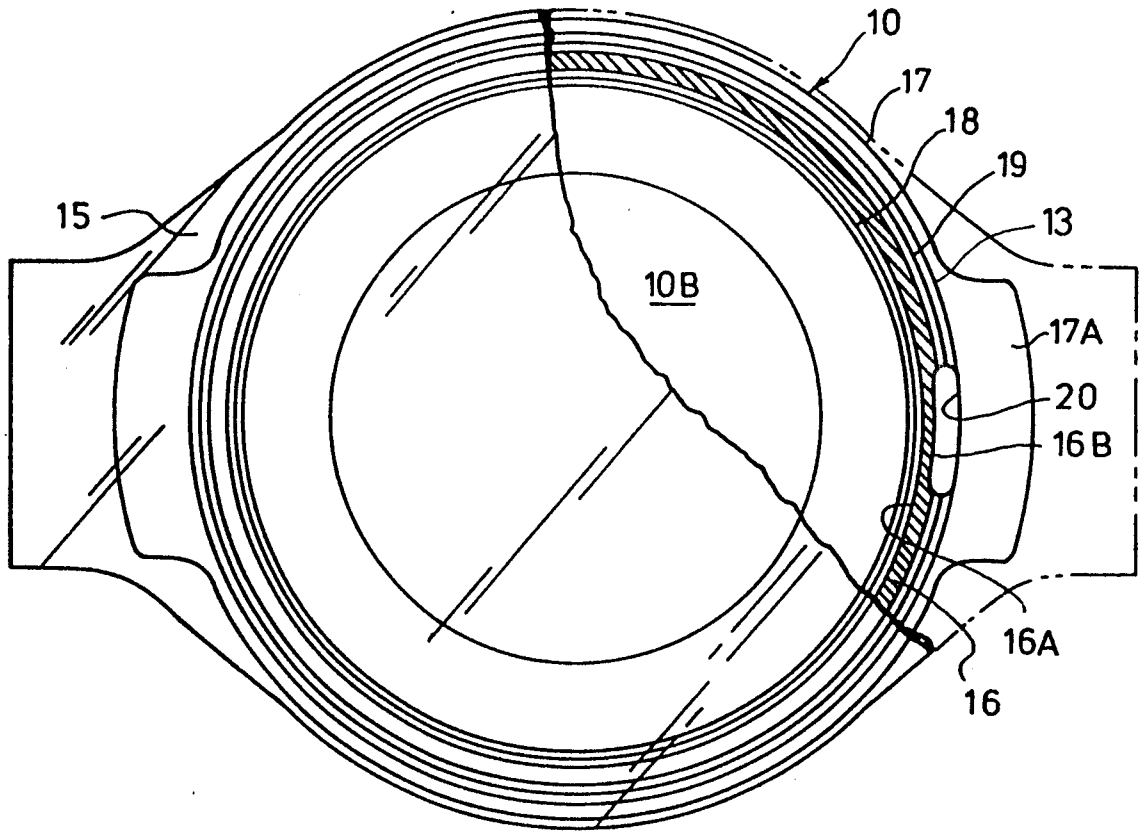

According to the above-described embodiment, although the shape of the hole portion 20 serving as the non-sealing portion is formed to be of circular, the present invention is not limited to this description. For example, it may, as shown in FIG. 6(A), be a circular arc-like shape and the like. As shown in FIG. 6(B), a structure may be employed arranged such that the hole portion 20 may be formed only in the flange portion 13 of the main container body 10.

According to the above-described embodiments, although the bent portion formed in the flange portion 13 of the main container body 10 is arranged to be the skirt portion 14, the bent portion according to the present invention is not limited to this. For example, it may be formed to be a shape of rib or a curl. In addition, it may be structured such that tabs 17A are extended over the ribs 17 formed in the flange portion 13.

Figure 9:
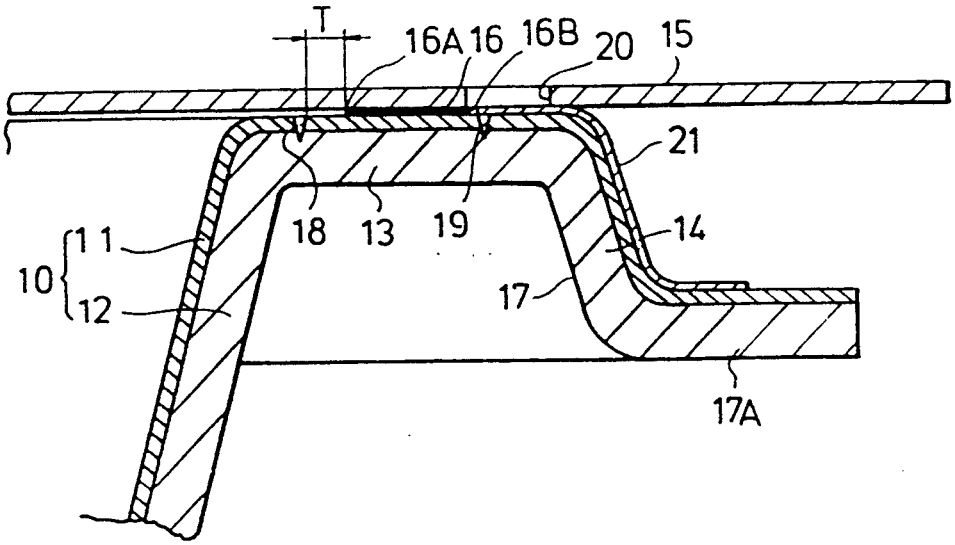
Figure 8:
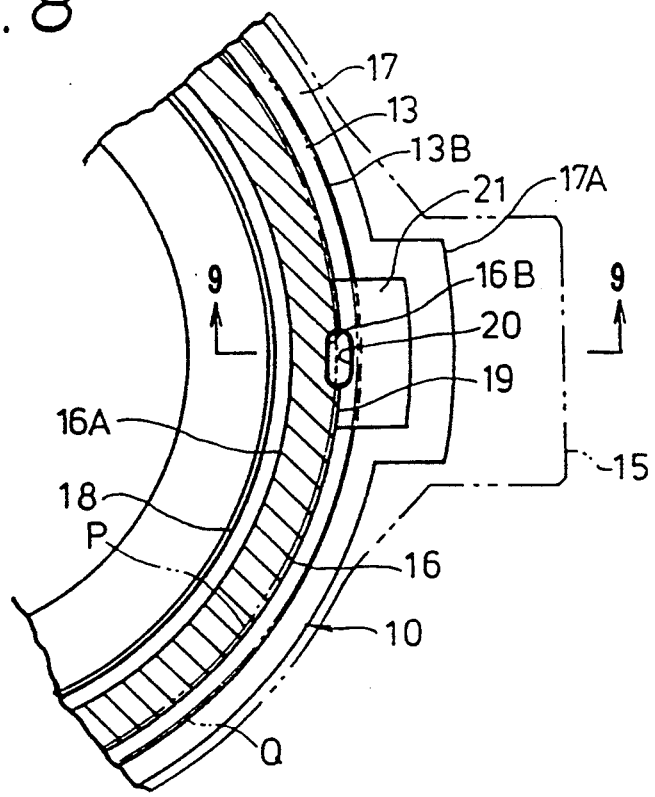
Figure 10:
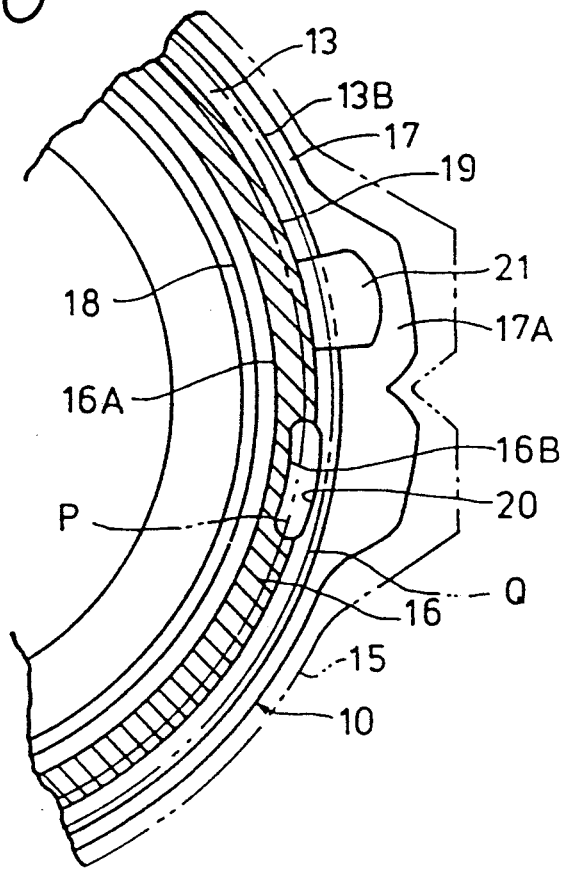

According to the present invention, when the sealing portion 16 is formed by heat sealing, a structure may be employed arranged such that the non-sealing portion is, as shown in FIGS. 8 to 10, formed by a non-heat adhesive resin layer 21 or a heat-resisting label (omitted from illustration) made of an aluminum foil, paper, or the like is applied to the flange portion 13 in the outside portion including the above-described cutting line 19. In addition, the non-sealing portion may be formed by using both the above-described hole portion 20 and the non-heat adhesive resin layer 21. This non-heat adhesive layer 21 is comprises a high melting point thermoplastic resin layer or a thermosetting resin layer applied to or printed on the surface of the flange portion 13 as to have the thickness of 1 to 5 μm. This thermosetting resin is exemplified by: polyamide, polyester, polyamide-cellulose nitrate copolymer, cellulose nitrate-silicon resin copolymer, silicon resin, urethane resin, and aminoalkid resin. The container shown in FIGS. 8 and 9 is arranged such that the hole portion 20 is formed in the cover 15, while the container shown in FIG. 10 is arranged such that the hole portion 20 is formed in the cover 15 and the flange portion 13. According to these containers, even if the seal outer periphery 16B were, as designated by an arrow P shown in FIGS. 8 and 10, positioned inner than the cutting line 19, the cover 15 can be readily separated from the inner end of the hole portion 20. Furthermore, even if the seal outer periphery 16B passed outward, as designated by an arrow Q, the cutting line 19 and the hole portion 20, the cover 15 can be readily separated at the cutting line 19 since the portion to which the non-heat adhesive resin layer 21 is not applied is not heat sealed.

According to the present invention, alternative to the structure arranged such that the inner and the outer weakening lines comprise the notch 18 and the cutting line 19, respectively, a structure may be employed such that the same comprises a recessed portion (omitted from illustration). This recessed portion can be formed by an edge of a sealing member when the cover 15 is welded to the flange portion 13 for sealing by using this sealing member.

Figure 11:
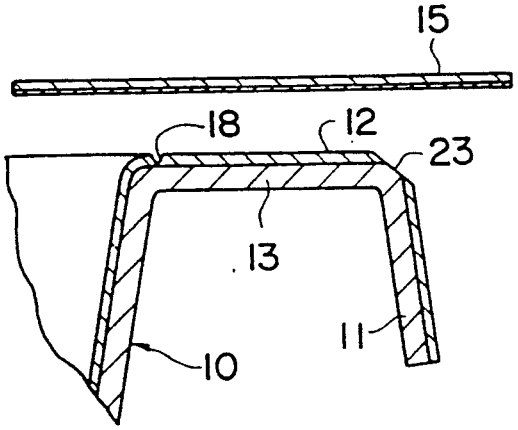
FIG. 11 is a cross-sectional view which illustrates a fourth embodiment of the container according to the present invention.

A forth embodiment of the present invention is shown in FIG. 11. This embodiment is characterized in that the outer corners of the flange portion 13 are cut and a boundary surface 23 of the inner layer 11 and the outer layer 12 which are positioned in contact with each other is allowed to appear. As a method to allow this boundary surface 23 to appear, any method may be employed if the boundary surface 23 is allowed to appear for the purpose of causing the separation between the inner layer 11 and the outer layer 12 which is positioned in contact with the former layer to start. In many case, the outer corners of the flange portion 13 are formed by grinding, cutting in, cutting, melting on their periphery thereof. The container having the outer corners in the flange portion 13 can be molded by a special method. The above described method in which the boundary surface 23 is allowed to appear is the most preferable method for the separation to start at this linear portion. However, another structure may be employed, for example which is arranged such that it is allowed to appear partially if separation can start and the effect of the present invention is substantially achieved.

Figure 12:
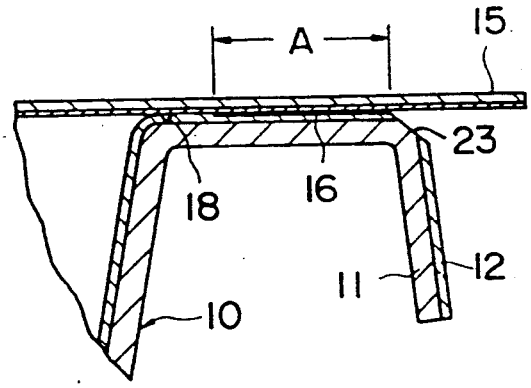
FIG. 12 is a partial cross-sectional view which illustrates a state in which a cover according to the previous embodiments is heat sealed.

FIG. 12 is a partial cross-sectional view which illustrates a state where the cover 15 is heat sealed to the main container body 10 according to the above-described fourth embodiment. This heat seal portion 16 is formed in a region A.

Figure 13:
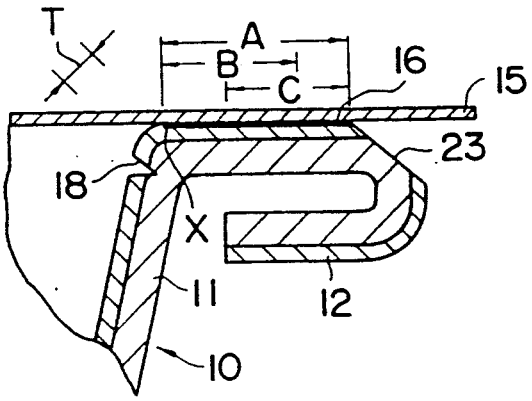
FIG. 13 is a cross-sectional view which illustrates an essential portion of a modified example of the fourth embodiment.

FIG. 13 is a partial cross-sectional view which illustrates a portion in the vicinity of the flange portion 13 in the case where the cover 15 is heat sealed to the main curled-container body 10 according to another example of the fourth embodiment.

Referring to this drawing, the notch 18 is formed in the inner layer 11 at the inner wall of the main container body 10. This notch 18 may be, in the form of a circle, triangle, rectangular or the like, disposed all round of the flange portion 13 in the vicinity of the inner edge of this flange portion 13. Alternately, it may be provided partially with a portion remained. In the case where the cover 15 is separated with a portion thereof remained, it needs for the structure to be arranged in such a manner that any cutting is not provided in this portion. It is preferable that this heat sealing portion 16 is provided in the region designated by the symbol A shown in FIG. 13. The separation can be conducted if the same were provided in the region C. However, in the region B, the separation cannot be performed.

When the cover 15 is heat sealed to the above-described main container body 10, length T from the inner end of the heat sealed portion to the notch is 0.5 mm to 10 mm in general, preferably 1.5 mm to 5 mm. If it is difficult to make the T to be within the above-described region when the heat sealing is performed, it is preferable that a slanted surface is provided in the inner surface of the flange portion as to make it a non-sealing region to be provided with a cutting. Alternatively, the non-sealing portion may be formed in a stepped shape, or a portion which cannot be fused by heat may be provided in the inner layer of the main container body so as to be a non-sealing region. In the case where the above-described non-sealing portion having the width T is provided, a stress is concentrated to a point X illustrated when the cover is separated from the inside. As a result, the separation from the notch 18 becomes difficult to be performed, causing the peel strength from the inside to become larger than that from the outside. Therefore, its pressure resistance can be raised and the sealing performance can be improved.

The shape of the main body 10 of the multilayered container according to the present invention is not limited specifically. It is preferable that it is formed to be of circular in general, and a polygon such as a rectangular can be employed. Thus, the cover is angularly heat sealed along the flange portion of the shape described above. The shape may be arranged to be in the form of a cup-like shape or a tray-like shape. The notching of the outer periphery of the flange portion 13 of the circular shape of the main body of the multilayered container and the notching of the inner end portion can be readily performed by rotating at least either the container or the notching tool.

The other structure and operation are substantially the same as those of the above-described embodiments.

According to the thus-structured embodiments, an effect can be obtained which is any cut does not need to be formed on the outer periphery of the sealing portion 16.

EXAMPLES

Then, the present invention will be described in detail with reference to the examples. However, the present invention is not limited to the following examples.

EXAMPLE

A sheet (thickness 0.8 mm) formed by six layers made of four types of materials was molded where a : b : c : d : c : b = 50 : 350 : 20 : 30 : 20 : 350 (μm).

a: high density polyethylene (Idemitsu Polyethylene 440M manufactured by Idemitsu Petrochemical Co. Ltd. density: 0.96g/cm$^2$, MI: 0.9g/10 minutes, molecular weight distribution: restricted)

b: a mixture of 80 wt % polypropylene resin (Idemitsu Polypro E-100G manufactured by Idemitsu Petrochemical Co., Ltd., MI: 0.6g/10 minutes) and 20 wt % low density polyethylene resin (Berosen 172 manufactured by Toyo Soda Industry Co., Ltd., density: 0.92g/cm$^2$, MI: 0.3g/10 minutes, molecular weight distribution restricted)

c: maleic acid anhydride denatured polypropylene (Idemitsu Politac R100 manufactured by Idemitsu Petrochemical Co., Ltd.)

d: ethylene-vinyl acetate copolymer suspension (EVA; EP-F101 manufactured by Kuraray Co., Ltd., rate of ethylene contained: 32 mol %, MI: 1.3g/10 minutes)

By heating the thus-prepared multilayered sheet up to a degree at which the molding could be performed, cup container of a diameter of 60 mm and 70 mm in height was obtained by vacuum molding. After the flange portion of the container had been curled, the annular notching was formed in the upper portion of the side wall and the outer corners of the flange portion were cut so that a container shown in FIG. 13 was obtained, where A = 2 mm and T = 1.5 mm.

The cover formed by a multilayered film made of [oriented nylon/polyvinylidene/straight-chain low density polyethylene (15 μ/20 μ/40μ)] was put on this container, and the flange portion was heat sealed all round.

The thus-obtained container was able to be separated from the outer end of the sealed portion of the flange portion between the layers of the container similarly to the separation realized in the flat flange provided container. Furthermore, the container stably displayed a peel strength of 1200g/15 mm and clear separation surface.

Then, a method of and an apparatus for notching the container according to the present invention will be described.

The same or similar components to those of the above-description are given the same reference numerals.

The main container body 10 is formed in the cylindrical shape, and the flange 13 to be welded for sealing to the cover 15 is formed all round in a circular opening 10A. The outer periphery 13B of this flange 13 is formed with a rib 14A serving as the bent portion is so forward as to face the bottom surface of the container. This main container body 10 is formed in a multilayered structure consisting of at least two layers stacked to each other in such a manner that the inner layer 11 can be separated from the outer layer 12. The peel strength between the inner layer 11 and the outer layer 12 is arranged to be substantially the same as that realized in the above-described embodiments. The notch 17 and the cutting line 18 are formed in the inner layer 17 disposed on both sides of the sealing portion 16 of the flange portion 11.

The material, the combination of the layers and the like in the main container body 10 are the same as the above-described embodiments.

Then, an apparatus for notching the main container body 10 will be described with reference to FIGS. 14 and 15.

Figure 14:
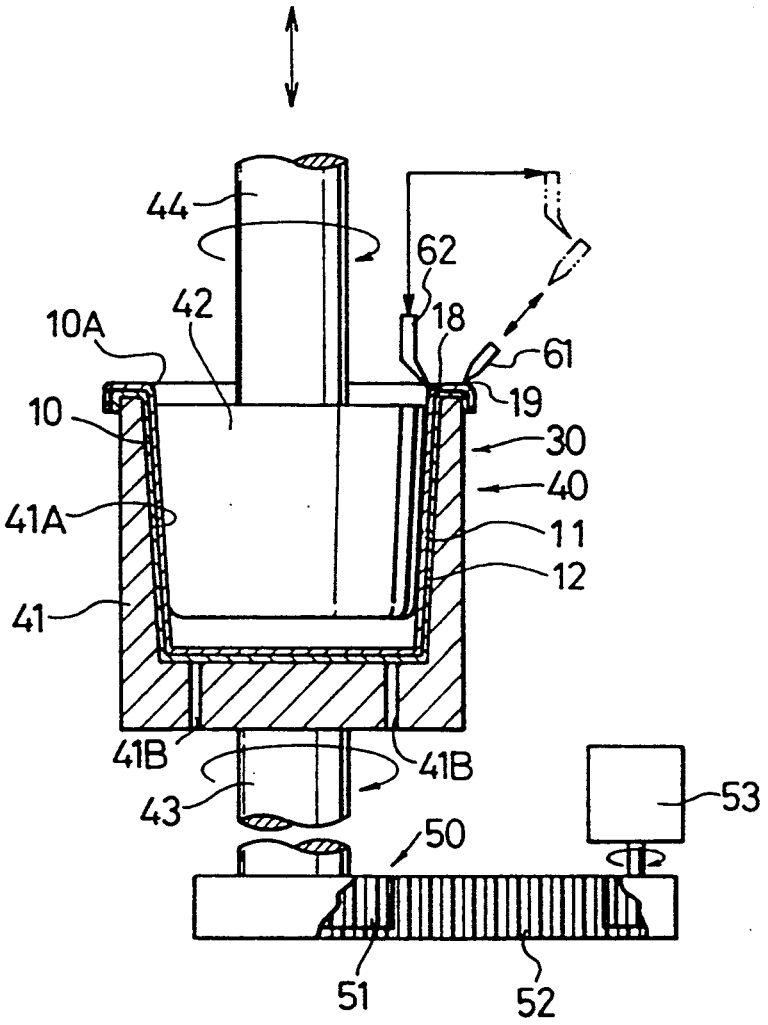
FIG. 14 is a schematic structural view which illustrates an apparatus in which a notching method of the container according to the present invention is embodied.

Referring to FIG. 14 which is a view which illustrates the schematic structure of this apparatus, a notching apparatus 30 comprises: holding means 40 for holding the main container body 10; rotating means 50 for rotating this holding means 40 relative to the center of the opening 10A in the container; first and second notching blades 61 and 62 for forming the above-described cut 17 and the cutting line 18 in the main container body 10.

The above-described holding means 40 comprises: a container retainer 41 having a recessed portion 41A in which the main container body 10 is received; and a pressing member 42 for pressing the inner surface of the main container body 10 received in the above-described container retainer 41. The above-described container retainer 41 and the pressing member 42 are rotatably supported by rotational shafts 43 and 44 fastened coaxially. The pressing member 42 is arranged to be able to move forward and retracted in the axial direction. When this pressing member 42 is retracted, the main container body 10 is arranged to be transported to and drawn out from the container retainer 41 by means (omitted from illustration). In addition, an air outlet hole 41B is formed in the bottom portion of the container retainer 41 so that the main container body 10 can be smoothly transported to and drawn out from the container retainer 41. Furthermore, by blowing out of air through the air outlet hole 41B, the main container body 10 can be taken out from the container retainer 41.

The above-described rotational means 50 comprises: a gear 51 connected to the container retainer 41 with a rotational shaft 43; and a motor 53 with a gear for rotating the gear 51 by using a timing belt 52. This motor 53 is arranged such that it intermittently rotates and stops so that when the same is being rotated, the cut is formed by the rotation of the container retainer 41 at the position which corresponds to at least the portion of the main container body 10 and the cover 15 in which the sealing therebetween is opened. The cut may be formed with a part thereof remained intact as an alternative to forming it all round.

The above-described first notching blade 61 is disposed in such a manner that the front end portion thereof can be brought to contact with the position at which the cut 19 is formed, for example, the same can be brought to contact with the outer periphery 13B of the flange 13. On the other hand, the notching blade 62 is disposed in such a manner that the front end portion thereof can be brought to contact with the position at which the cut 18 is formed, for example, the same can be brought to contact with the inner periphery 13A of the flange 13. These notching blades 61 and 62 are arranged to move forward and retract by a means (omitted from illustration) so that the front end thereof can reach the inner layer 11 of the main container body 10 when the same moves forward. On the other hand, when the notching blades 61 and 62 are retracted, they are arranged to retract diagonally above the container retainer 41 as shown in FIG. 1 4 so as not to interrupt the transportation and drawing out of the main container body 10. These notching blades 61 and 62 are secured so as not to be moved due to the contact with the main container body 10 when they are moved forward so that the above-described cuts 18 and 19 are assuredly formed in the main container body 10. These notching blades 61 and 62 may be, if necessary, heated as to readily form the cuts 18 and 19. The shape of these notching blades 61 and 62 may be formed in any shape which can form the cut such as that in a V-shape having a cut at the from end thereof.

A method of notching the main container body 10 by using the apparatus which is thus-structured will be described with reference to FIG. 15. In FIG. 15, the rotational means is omitted from illustration and the main container body 10 is illustrated to be singlelayered body for making the description simple.

Figure 15A:
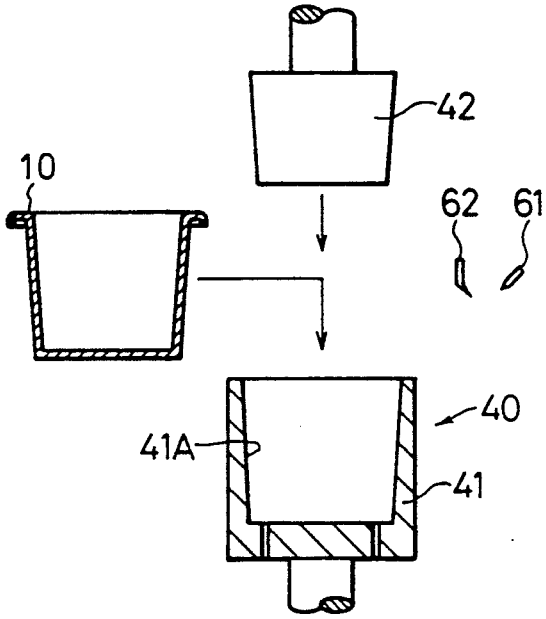
Figure 15D:
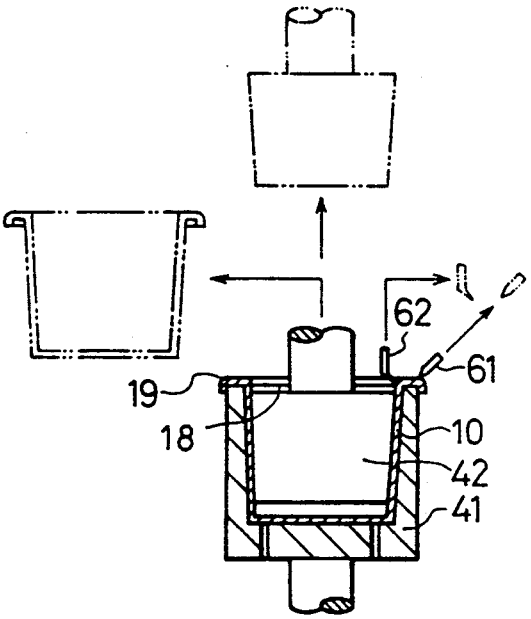
Figure 15B:
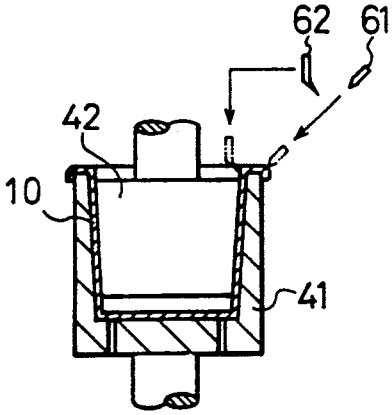
Figure 15C:
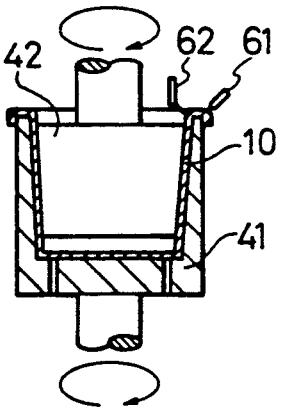

As shown in FIG. 15A, when the pressing member 42 and the notching blades 61 and 62 are respectively at the retracted positions, the pressing member 42 is moved forward after the main container body 10 in which the cuts have not been formed as yet have been received by the recessed portion 41A in the container retainer 41 so that the main container body 10 with the container retainer 41 are held. Then, as shown in FIG. 15B, the notching blades 61 and 62 are moved forward, and simultaneously, the rotational means 50 (see FIG. 1) is rotated as shown in FIG. 15C as to rotate the container retainer 41 by a predetermined angular extent, for example, at least one rotation. As a result, the cuts 18 and 19 are simultaneously formed in the main container body 10. At this time, although the pressing member 42 is simply and rotatably supported by the rotational shaft 44, the same with the container retainer 41 holds the main container body 10 strongly enough. Therefore, it rotates with the container retainer 41. Furthermore, as shown in FIG. 15D, the pressing member 42 is retracted after the notching blades 61 and 62 have been retracted, and the main container body 10 in which the cuts 18 and have been formed is drawn out.

In order to change the position at which the cuts 18 and 19 are formed, the relative positions between the notching blades 61 and 62 needs to be adjusted.

According to the thus-formed embodiment, since the main container body 10 is rotated by the holding means 40 with the notching blades 61 and 62 positioned in contact with this main container body 10, the cuts 18 and 19 can be assuredly formed in the flange portion 13 regardless of the non-uniform thickness of the flange portion 13, in particular, regardless of the non-uniform thickness of the outer layer 12 even if the flange portion 13 has the rib 14A thereon. Furthermore, by using a proper type of blades as the notching blades 61 and 62, the cuts 18 and 19 can be formed regardless of the material for the inner layer 11, that is even if the material were high melting point or high strength resin, or metal such as aluminum, the cuts 18 and 19 can be formed. In addition, by adjusting the relative positions of the notching blades 61 and 62, the above-described cuts 18 and 19 can be formed at any desired positions in the flange portion 13. In particular, by means of forming of the cuts 18 and 19 in the outer periphery 13B and the inner periphery 13A of the flange portion 13, the width to be sealed does not need to be strictly set when the cover 15 is welded for sealing on the flange portion 13 of the main container body 10 As a result, the sealing work for the main container body 10 can be readily conducted. In addition, expensive annular notching blades can be replaced by relatively cheap notching blades 61 and 62 above, the cost required to form the cuts can be reduced.

Then, the other embodiment will be described with reference to FIGS. 17 to 19.

This embodiment is arranged such that the structure of the means for holding the main container body 10 and the notching blade are different from those of the above-described embodiments. However, the structure of the main container body an the rotational means 50 are the same as those of the above-described embodiments. The rotational means 50 is omitted from illustration in FIGS. 17 and 18.

Referring to FIG. 17 which is a view which illustrates the schematic structure, the holding means according to this embodiment comprises a vacuum adsorption means 45 for adsorbing, by its negative pressure, the inside of the main container body 10 which has been brought adjacent by a lifting means (omitted from illustration). This vacuum adsorption means 45 is formed in a substantially circular cylinder having a recessed portion at the base portion thereof, this vacuum adsorption means 45 comprising, in the shaft thereof, an inlet/outlet hole 45A which is connected to a pressure reducing system and/or high pressure system (omitted from illustration). This vacuum adsorption (blowing-out attaching/detaching) means 45 is arranged to be rotated with connected to the above-described rotational means 50 (see FIG. 14) and the main container body 10 thereby held.

The notching blade according to this embodiment comprises: a rotary type notching blade 63 for forming the cut 19 (see FIG. 19) by diagonally notching the outer periphery 13B of the flange portion 13; and a notching blade 64 for forming the above-described cut 18 in the inner periphery 13A of the flange portion 13. The above-described notching blade 63 is arranged to be capable of moving forward and retracting so that when the same is moved forward, the cut 19 can reach the inner wall 11 of the main container body 10. The above-described notching blade 64 formed in a hook shape and capable of rotating relative to the base end portion thereof, the notching edge formed at the front end thereof being always abutted under a predetermined urging force against the inner periphery 13A of the flange portion 13 by means of a spring (omitted from illustration), while the same being capable of retracting against the above-described urging force when this notching edge does not form the cut. Thanks to the thus-formed method, the cut can be formed in the inner layer 11 by means of a press molding, causing an advantage in that the cuts exhibiting a predetermined depth can be formed even if the portion of the main container body 10 at which the cut is formed were not of uniform.

A method of forming the cut in the main container body 10 by using the notching apparatus according to this embodiment and structured as described above will be described with reference to FIG. 18. In FIG. 18, the main container body 10 is formed in a single-layered structure for the purpose of making the description simple.

Figure 18A:
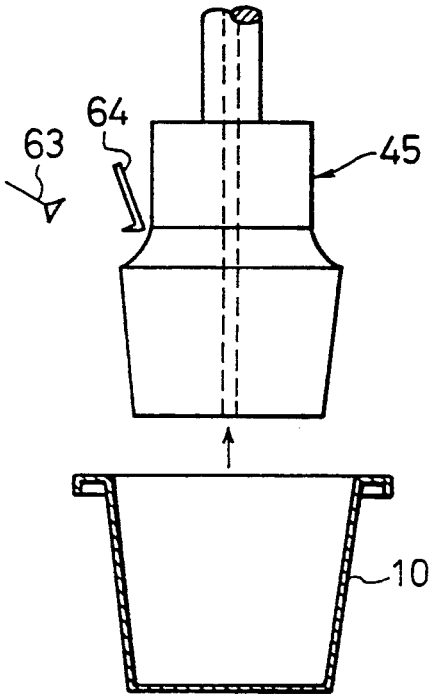
Figure 18D:
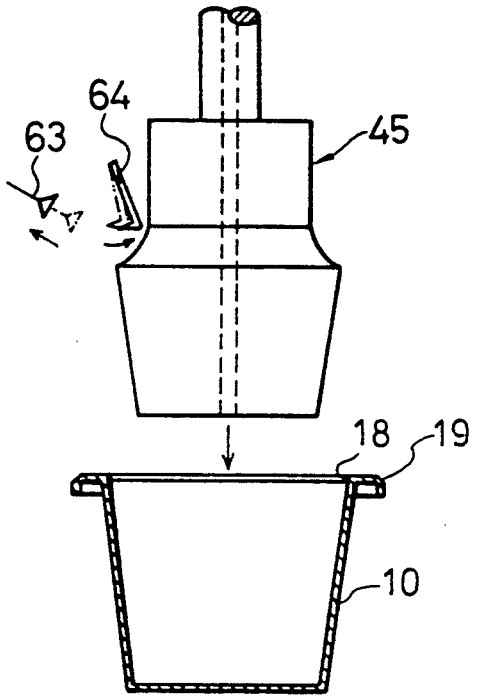
Figure 18B:
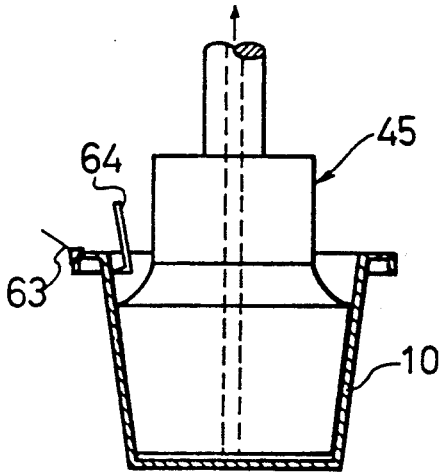
Figure 18C:
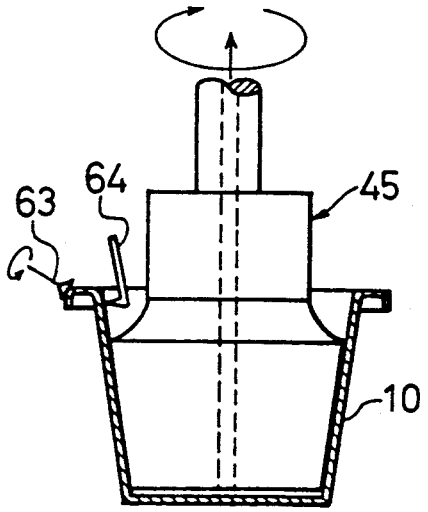

As shown in FIG. 18A, when the notching blades 63 and 64 are positioned at their retracted positions, the main container body 10 in which the cuts have not as yet been formed is brought to a position adjacent to the vacuum adsorption means 45 by the lifting means (omitted from illustration). Then, this vacuum adsorption means 45 is actuated so that the main container body 10 is held. As shown in FIG. 18B, the notching blades 63 and 64 are then moved forward, and the rotational means 50 (see FIG. 14) is rotated as shown in FIG. 18C for the purpose of rotating the vacuum adsorption means 45 by a predetermined angular extent, in general one rotation. As a result, the cuts 18 and 19 are simultaneously formed in the main container body 10 (see FIG. 19). Then, as shown in FIG. 18D, the operation of the vacuum adsorption means 45 is stopped after the notching blades 63 and 64 have been retracted so that the main container body 10 is detached, if necessary with air blow. Then, the thus detached main container bodies 10 are accumulated in a predetermined portion by means of the lifting means (omitted from illustration).

Also according to this embodiment, the cut 18A designated by an imaginary line shown in FIG. 19 can be formed by adjusting the relative positions of the notching blades 63 and 64.

According to the thus-structured embodiment, the similar effect to that obtained in the above-described embodiments can be obtained. In addition, the following effects can be obtained: since the holding means is arranged to comprise the vacuum adsorption means 45, the number of necessary parts can be reduced with respect to the above-described embodiments; since the notching blade 63 is arranged to be of a rotary type, the cut 19 can be smoothly and assuredly formed.

Then, the other embodiments of the method and apparatus for notching the container according to the present invention will be described with reference to FIG. 20.

This embodiment is structured such that the notching apparatus 30 is included in the container printing apparatus and characterized in that the structure of the rotational means and the position of the notching blade are different from the those of the above-described embodiments. However, the structures of the holding means and the container are the same. In order to make the description simple, the notching blade is omitted from illustration.

The vacuum adsorption means 45 serving as the holding means according to this embodiment is rotatably fitted to the front end of the rod-like shaped support member 71A formed radially over the rotational center of the of a container floating means 71.

The notching blades 61 to 64 according to this embodiment is formed in similar shape as that of the above-described embodiments (see FIGS. 14, 15, 17, and 18), and is fastened to the above-described support member 71A. The notching blades are, similarly to those in the above-described embodiments, arranged such that the front ends thereof can reach the inner layer 11.

The rotary means comprises a printing roll 55 for printing the outer surface of the main container body 10 held by the above-described vacuum adsorption means 45. When this printing roll 55 is rotated, the main container body 10 is also rotated due to the friction with the printing roll 55. The rotation of this main container body 10 may be arranged to be performed in the other zones such as the dry portion as an alternative to the printing portion.

With the thus-structured apparatus according to this embodiment, the cut can be, in general, formed in the main container body 10 during the printing process. That is, the main container body 10 held by the vacuum adsorption means 45 is also rotated in correspondence with the rotation of the printing roll 55. During this rotation, the cuts can be formed in the main container body 10 by the notching blades fastened to the support member 71A.

According to this embodiment, since the cuts can be formed in the main container body 10 during the above-described printing process, an advantage in terms of saving labor needed in manufacturing the containers can be obtained.

Then, a still further embodiment of the present invention will be described with reference to FIGS. 21 and 22.

The difference from the above-described embodiments lies in that the notching blades are moved with respect to the container and in the shape of the bent portion formed in the flange portion 13 of the main container body 10.

The flange portion 13 formed in the main container body 10 to be formed with the cuts is provided with a curling 14B serving as the bent portion in the outer periphery 13B thereof.

The holding means according to this embodiment comprises a recessed portion 46A for accommodating the main container body 10, and this holding means is arranged to be the vacuum adsorption means 46 for adsorbing the main container body 10 by its negative pressure. This vacuum adsorption means 46 is arranged to be capable of moving forward and retracting by a cylinder 47. When the vacuum adsorption means 46 is moved forward, it adsorbs the main container body 10, while it releases its pressure as to cause the main container body to be taken out or taken in by a means (omitted from illustration) when it is retracted.

The notching blade 65 has its notching edge at the side edge of the bent front end portion thereof so that the cut 19 (see FIG. 22) is formed diagonally in the outer periphery of the flange portion 13. The notching blade 66 is arranged to have the similar shape as that of the above-described embodiments so that the cut 18 is formed. These notching blades 65 and 66 are fastened to the front end of a plate member 67 having the base end thereof which is connected, with the rotational shaft 44, to the above-described rotational means 50 according to the above-described embodiments. Since the above-described notching blade 65 and 66 are moved in the circumferential direction of the main container body 10 by this rotational means 50, the above-described cuts 18 and 19 can be formed in the main container body 10. According to this embodiment, the above-described plate member 67 is arranged to be of elastic for the purpose of making the above-described notching blades 65 and 66 against the main container body 10 with a predetermined urging force when the vacuum adsorption means 46 is moved forward.

According to this embodiment structured as described above, after the main container body 10 has been accommodated in the recessed portion 46A in the retracted vacuum adsorption means 46, the vacuum adsorption means 46 is moved forward. Then, the notching blades 65 and 66 are rotated by the rotational means. As a result, the cuts 18 and 19 (see FIG. 22) are formed. After the above-described cuts 18 and 19 have been formed, the vacuum adsorption means 46 is retracted and the main container body 10 is transported.

According to the thus-structured embodiment, the cuts 18 and 19 can be assuredly formed in the flange portion 13 having the curling 14B of the main container body 10. In addition, since the vacuum adsorption means 46 does not need to be rotated, the structure of this vacuum adsorption means 46 can be simplified.

Although the structure is so arranged according to the above-described embodiments that the rib 14A or the curling 14B is formed in the outer peripheral 13B of the flange portion 13 provided for the main container body 10, the shape of the flange portion 13 to be applied to the present invention may be, as shown in FIG. 23, formed flat as an alternative to the shape having the rib or the like. In addition, as an alternative to provision of the two cuts, the number of the same may be, as shown in FIG. 23, one or three or more. As an alternative to using two notching blades for the purpose of forming two cuts according to the above-described embodiments, the two cuts may be formed by one notching blade. According to the present invention, the cuts may be formed in the main container body 10 by moving both the holding means 40 (vacuum adsorption means 45 and 46) and the notching blade. In addition, the above-described rotational means formed by the gears, the timing belt and the motor according to the above-described embodiments may be formed any means comprising a pulley, a belt, and a motor, or means comprising a plurality of gears and a motor if the same can rotate at least either of the holding means and the notching blade.

According to the present invention described above, a container exhibiting an excellent sealing performance and capable of being readily opened can be provided. In addition, an effect that the cuts can be formed at any positions in the flange can be obtained. Furthermore, since the cuts can be readily formed in the inner wall on the inside of the flange portion of the container, the overall portion of the flange surface can be tightly sealed when the cover of the container is tightly sealed to the main container body as well as the effect of forming the cuts. Consequently, a great advantage can be obtained in the field of the packing.

What is claimed is:

1. A container formed by a main container body having a flange portion and a cover welded to said flange portion to provide a sealing portion, said container comprising:

an inner layer which forms an inside portion of said main container body and an outer layer which contacts said inner layer such that it can separate from said inner layer, wherein the adhesion force between said inner layer and said outer layer is arranged to be smaller than the sealing force between said flange portion of the main container body and said cover at said sealing portion, an inner weakening line formed by a notch located inwardly of the sealing portion in the flange portion and an outer weakening line formed in a portion of the flange located outwardly from said sealing portion, and at least one non-sealing region formed in said flange portion at a position which includes a portion of said outer weakening line.

2. A container according to claim 1, wherein a bent portion is formed in said flange portion of said main container body and said at least one non-sealing region is formed at said bent portion by cutting out a portion of the bent portion.

3. A container according to claim 2, wherein said non-sealing region comprises a portion of said flange portion at which said flange portion is angularly cut so that a boundary surface between the inner layer and the outer layer is exposed.

4. A container according to claim 3, wherein the portion of the portion flange at which the boundary surface is exposed is arranged at an outer corner of the flange portion.

5. A container according to claim 3, wherein said exposed boundary surface is arranged immediately adjacent to said sealing portion in order to promote separation of the cover.

6. A container according to claim 1, wherein the inner weakening line is spaced from the sealing portion.

7. A container according to claim 3, wherein the portion of the flange portion at which the boundary surface is exposed is arranged at an outer periphery of said flange portion.

8. A container according to claim 1, wherein the at least one non-sealing region is formed in said flange portion by removing a selected portion of the inner layer to expose a portion of the outer layer which also provides a boundary surface between the inner layer and the outer layer.

9. A container according to claim 5, wherein said exposed boundary surface is arranged immediately adjacent to said sealing portion in order to promote separation of the cover.

10. A container formed by a main container body having a flange portion and a cover welded to said flange portion to provide a sealing portion, said container comprising:

an inner layer which forms an inside portion of said main container body and an outer layer which contacts said inner layer such that it can separate from said inner layer, the adhesion force between said inner layer and said outer layer being smaller than between said flange portion of a main container body and said cover, a cover having at least one sealing layer which is welded to said flange portion to form said sealing portion, an inner weakening line formed by a notch located inwardly of the sealing portion in one of the flange portion and the cover and an outer weakening line formed by a cut portion located outwardly from said sealing portion, a portion of said cut portion removing a portion of the inner layer and exposing a surface portion of the outer layer.

* * * * *